US008421688B2

(12) United States Patent
Tu

(10) Patent No.: US 8,421,688 B2
(45) Date of Patent: Apr. 16, 2013

(54) SOLID ANTENNA WITH UPPER-LOWER STRUCTURE

(75) Inventor: Hsin-Lung Tu, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 374 days.

(21) Appl. No.: 12/948,768

(22) Filed: Nov. 18, 2010

(65) Prior Publication Data

US 2012/0105291 A1 May 3, 2012

(30) Foreign Application Priority Data

Mar. 15, 2013 (CN) ..... 2010 2 0587467

(51) Int. Cl.
*H01Q 1/24* (2006.01)

(52) U.S. Cl.
USPC ..... 343/702; 343/700 MS

(58) Field of Classification Search ..... 343/702, 343/700 MS
See application file for complete search history.

(56) References Cited

U.S. PATENT DOCUMENTS

| | | | | |
|---|---|---|---|---|
| 7,312,760 | B1 | 12/2007 | Cheng et al. | |
| 7,589,679 | B2 * | 9/2009 | Shih | 343/702 |
| 7,609,209 | B2 * | 10/2009 | Shih | 343/700 MS |
| 2009/0267840 | A1 * | 10/2009 | Xu et al. | 343/700 MS |

* cited by examiner

*Primary Examiner* — Hoang V Nguyen
(74) *Attorney, Agent, or Firm* — Altis Law Group, Inc.

(57) ABSTRACT

A solid antenna configured above a substrate includes a short portion, a feeding portion and a radiating portion including four radiators connected one-by-one. A first radiator includes a first upper section on a first plane, a first lower section on a second plane, and a first connection section connecting the first upper section to the first lower section. The second radiator includes a second upper section on the first plane, and a second connection portion connecting the second upper section to the first lower section. The third radiator includes a third upper section and a fourth upper section on the first plane, a second lower section on the second plane, a third connection section connecting the third upper section to the second lower section, and a fourth connection section connecting the second lower section to the fourth upper section. The fourth radiator extends towards the substrate.

10 Claims, 5 Drawing Sheets

SOLID ANTENNA WITH UPPER-LOWER STRUCTURE

BACKGROUND

1. Technical Field

Embodiments of the present disclosure relate to antennas, and particularly to a solid antenna with an upper-lower structure.

2. Description of Related Art

Antennas are necessary components in wireless communication devices for transceiving electromagnetic signals. In order to obtain compact wireless communication devices, the antennas associated therewith are correspondingly required to be designed with small size, as well as maintaining proper performance standards.

DETAILED DESCRIPTION

Figure 1:
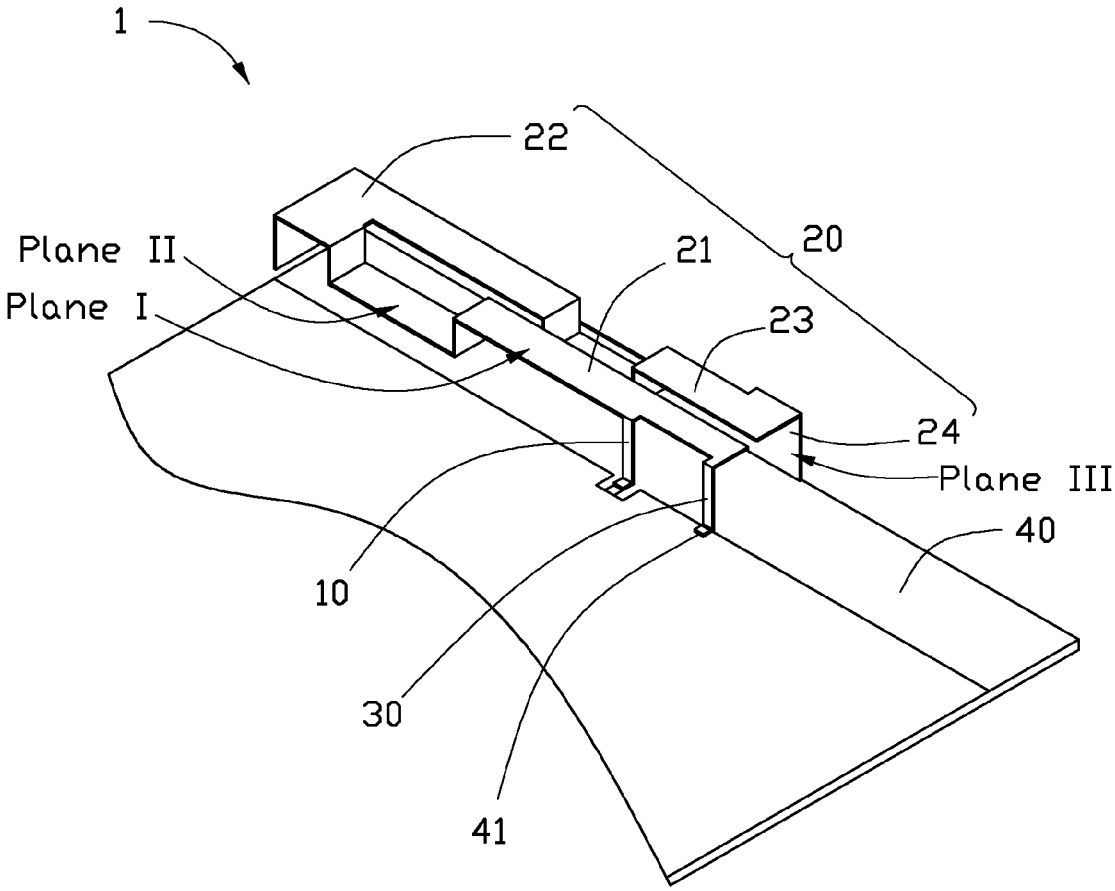
FIG. 1 is a schematic diagram of one exemplary embodiment of a solid antenna with an upper-lower structure of the present disclosure.
Figure 2:
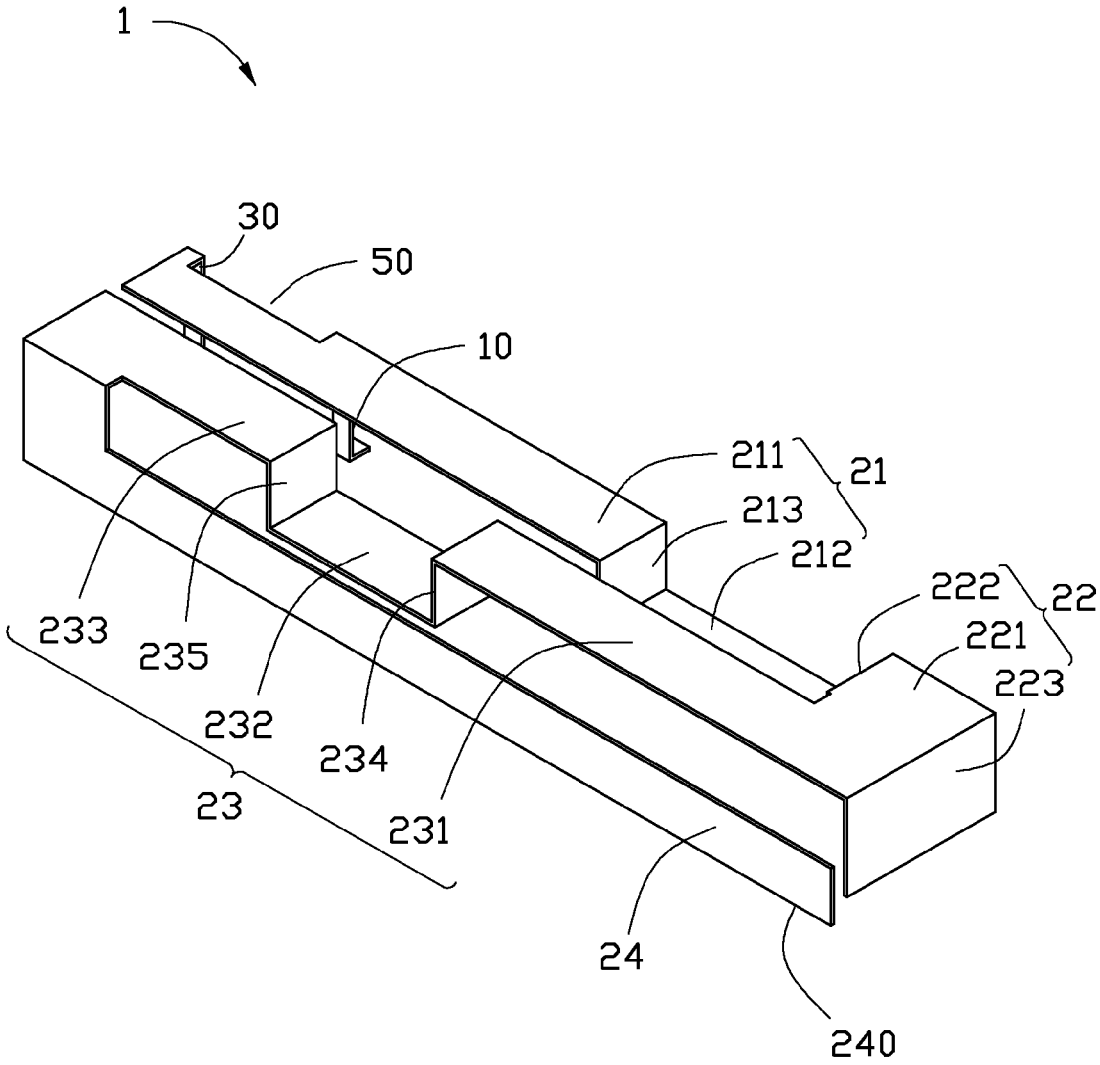
FIG. 2 is a schematic diagram of one exemplary embodiment of an opposite view of the solid antenna with the upper-lower structure of the FIG. 1 of the present disclosure.

Referring to FIG. 1 and FIG. 2, schematic diagrams of one exemplary embodiment of two views of a solid antenna 1 with an upper-lower structure of the present disclosure is shown. The solid antenna 1 with the upper-lower structure is configured above (e.g., positioned on) a substrate 40. In this embodiment, the substrate 40 is a printed circuit board (PCB), such as FR4 type PCB. The solid antenna 1 with the upper-lower structure comprises a feeding portion 10, a radiating portion 20, a short portion 30, and a grounding portion 41. The grounding portion 41 is a layer of metal covering the substrate 40.

The feeding portion 10 is elongated, for feeding electromagnetic signals. The short portion 30 is elongated, and electrically connects to the grounding portion 41. In one embodiment, the feeding portion 10 and the short portion 30 are fixed to the substrate and collectively support the radiating portion 20 above the substrate 40, firmly. In other embodiment, space between the radiating portion 20 and the substrate 40 may be filled with insulation materials, such as foam, to auxiliary support the radiating portion 20 stably.

The radiating portion 20 comprises a first radiator 21, a second radiator 22, a third radiator 23, and a fourth radiator 24, for radiating the electromagnetic signals. In one embodiment, the radiating portion 20 can be made of patches of metal, such as aluminum pieces. The radiating portion 20 is formed by a plurality of metal patches disposed on different planes.

The first radiator 21 comprises a first upper section 211, a first connection section 213 and a first lower section 212, which are perpendicularly connected one-by-one. In one embodiment, the first upper section 211 is rectangularly shaped, and is positioned on a first plane I. The short portion 30 connects to one end of the first upper section 211 far away from the first lower section 213. The feeding portion 10 connects to a substantial middle part of the first upper section 211. In one embodiment, the first upper section 211 defines a first slot 50 between connections with the feeding portion 10 and the short portion 30. The operating frequency of the solid antenna 1 can be tuned by adjusting the dimensions of the first slot 50. The first lower section 212 is elongated, and positioned on a second plane II. As shown in FIG. 1, the first plane I and the second plane II are both in parallel to the substrate 40, and the second plane II is defined between the first plane I and the substrate 40.

The second radiator 22 comprises a second connection portion 222, a second upper section 221 and a first open end 223, which are perpendicularly connected one-by-one. The second connection portion 222 is positioned on the first plane I. The second connection section 222 connects the second upper section 221 to the first lower section 212. The first open end 223 perpendicularly connects to one end of the second upper section 221 far away from the second connection section 222, extending towards the substrate 40.

The third radiator 23 comprises a third upper section 231, a third connection 234, a second lower section 232, a fourth connection section 235 and a fourth upper section 233, which are perpendicularly connected one-by-one. In one embodiment, the third radiator 23 extends from the second radiator 22 towards the feeding portion 10. The third upper section 231 and the fourth upper section 233 are positioned on the first plane I, the second lower section 232 is positioned on the second plane II. In one embodiment, the third upper section 231 connects to the second upper section 221, which collectively form an L shape. The L shape structure makes the third radiator 23 and the first radiator 21 define a second slot 51 therebetween, as shown in FIG. 3.

In one embodiment, the first connection section 213, the second connection section 222, the third connection section 234, the fourth connection section 235, and the first open end 223 are substantially in parallel to each other, and substantially perpendicular to the substrate 40.

The fourth radiator 24 connects to the fourth upper section 233 perpendicularly and extends towards the substrate 40. In one embodiment, the fourth radiator 24 is positioned on a third plane III. As shown in FIG. 1, the third plane III is perpendicular to the substrate 40. The fourth upper section 233 is L-shaped, so that a third slot 52 is defined between the fourth radiator 24 and the third radiator 23 when the fourth radiator 24 is connected to one end of the L-shaped structure of the fourth upper section 233, as shown in FIG. 3. In one embodiment, the fourth radiator 24 is L-shaped, and comprises a second open end 240. The second open end 240 extends towards the first open end 223. The first open end 233 is perpendicular to the second open end 240, to reduce interference or noise in the electromagnetic signals radiated.

Figure 3:
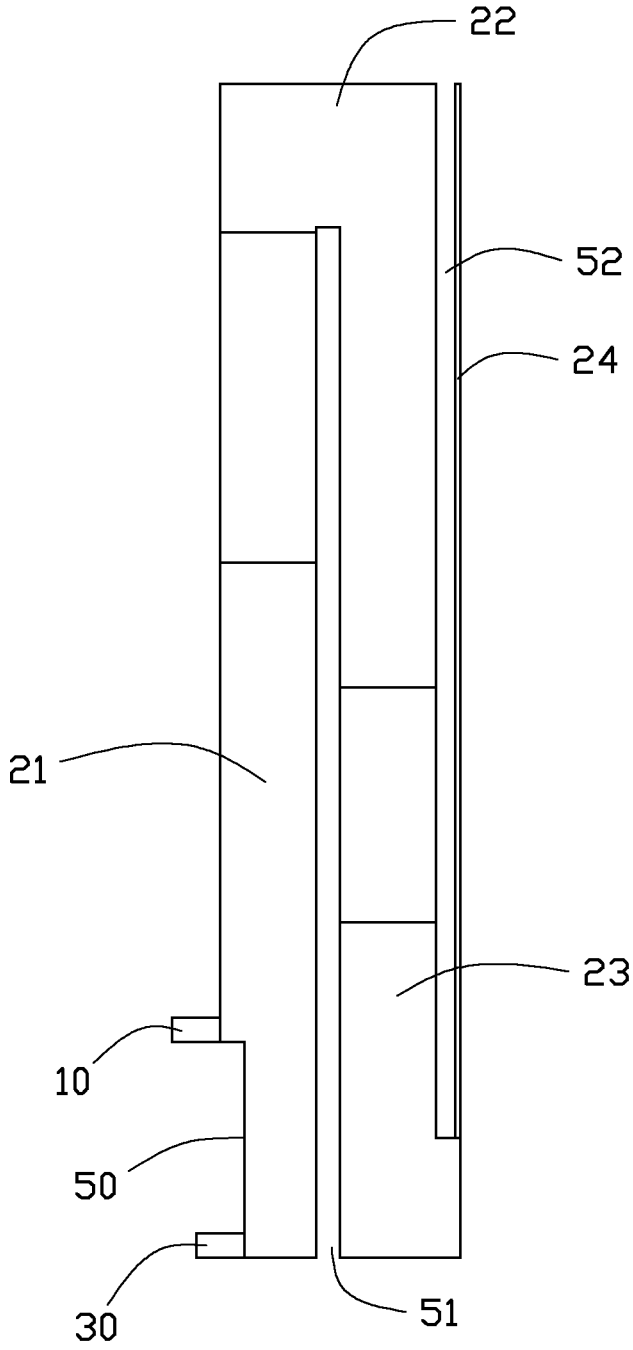
FIG. 3 is a schematic diagram of one exemplary embodiment of a top view of the solid antenna with the upper-lower structure of the FIG. 1 of the present disclosure.
Figure 4:
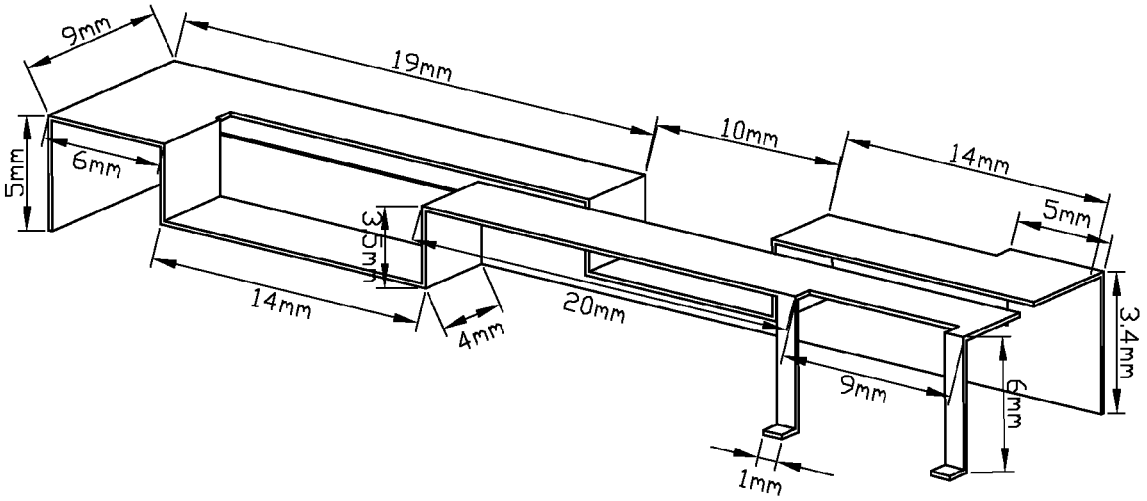
FIG. 4 is a schematic diagram of one exemplary embodiment of dimensions of the solid antenna with the upper-lower structure of the present disclosure.

Referring to FIG. 3, a schematic diagram of one exemplary embodiment of a top view of the solid antenna 1 of the FIG. 1 is shown. It can be seen as a projection of the radiating portion 20 on the substrate 40. The projection of the first radiator 21 is in elongated shape, and defines the first slot 50 between the feeding portion 10 and the short portion 30. The projection of the second radiator 22 is rectangularly-shaped. The projection of the third radiator 23 is L-shaped. The projection of the fourth radiator 24 is a line. The projection of the first radiator 21 and the third radiator 23 is spaced out by the second slot 51, the third radiator 23 and the fourth radiator 24 collectively define the third slot 52.

In one embodiment, the radiating portion 20 is configured with lower-upper structure to deduce the dimensions. Additionally, the bent radiating portion 20 can reduce coupling effect, to strength the radiating effect.

Referring to FIG. 3, a schematic diagram of one exemplary embodiment of a top view of the solid antenna 1 with the upper-lower structure of the FIG. 1 of the present disclosure is shown. The thickness of the solid antenna 1 is approximately 0.22 mm. The length of the feeding portion 10 and the short portion 30 are both approximately 6 mm, the width of both are approximately 1 mm, the distance between the two is approximately 9 mm. The total length of the first upper section 211 is approximately 29 mm, the length of the first slot 50 is approximately 9 mm, the length of the third upper section 231 is approximately 13 mm, the length of the fourth upper section 233 is approximately 14 mm, the width of the first, third and fourth upper sections 211, 231, 233 are approximately 4 mm. The length of the second upper section 221 is approximately 9 mm, and the width is approximately 6 mm. The length of the first lower section 212 is approximately 14 mm, the length of the second lower section 221 is approximately 10 mm, and the width of the first lower section 212 and the second lower section 221 are approximately 4 mm. The height of the first, second, third and fourth connection section 213, 222, 234 and 235 are approximately 3.5 mm, and the width of the connection sections 213, 222, 234 and 235 are approximately 4 mm. the height of the first open end 223 is approximately 5 mm, and the length is approximately 9 mm. The length of the fourth radiator 24 is approximately 39 mm.

Figure 5:
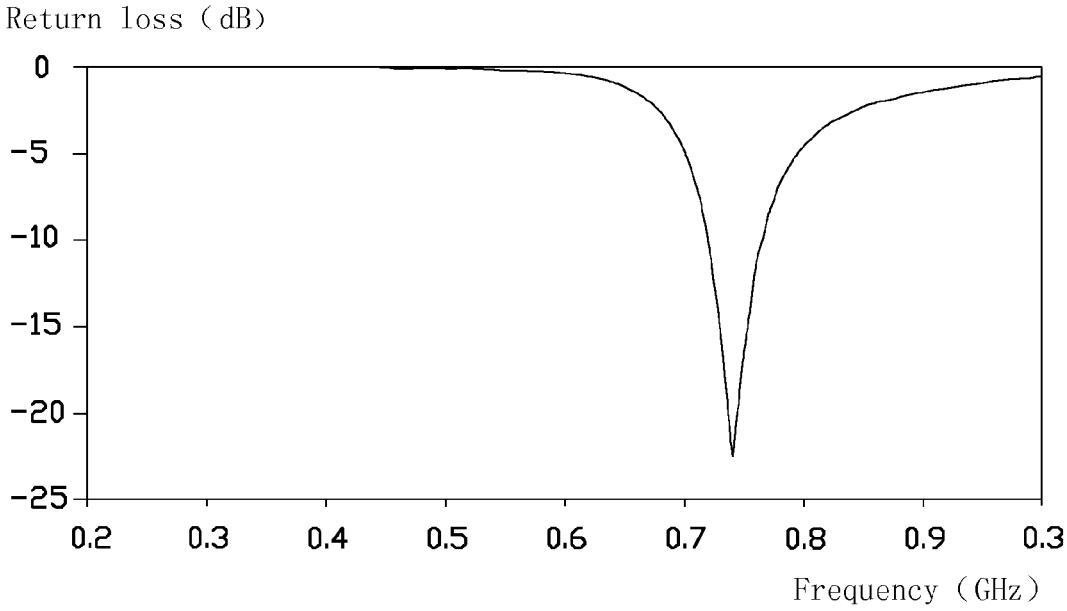
FIG. 5 is a graph showing of one exemplary embodiment of return loss of the solid antenna with the upper-lower structure of FIG. 1.

FIG. 5 is a graph showing of one exemplary embodiment of return loss of the solid antenna 1 with the upper-lower structure of FIG. 1. As shown, when the solid antenna 1 operates at frequencies of approximately 700 MHz, the return loss is less than −10 dB.

The description of the present disclosure has been presented for purposes of illustration and description, and is not intended to be exhaustive or limited to the disclosure in the form disclosed. Many modifications and variations will be apparent to those of ordinary skill in the art. Various embodiments were chosen and described in order to best explain the principles of the disclosure, the practical application, and to enable others of ordinary skill in the art to understand the disclosure for various embodiments with various modifications as are suited to the particular use contemplated.

What is claimed is:

1. A solid antenna configured above a substrate, the solid antenna comprising:

a short portion fixed to the substrate;

a feeding portion fixed to the substrate to feed electromagnetic signals; and a radiating portion for radiating the electromagnetic signals, the radiating portion comprising:

a first radiator comprising a first upper section on a first plane, a first lower section on a second plane, and a first connection section connecting the first upper section to the first lower section, wherein the second plane is defined between the first plane and the substrate, and the first upper section is electrically connected to and supported by the feeding portion and the short portion;

a second radiator comprising a second upper section on the first plane, and a second connection portion connecting the second upper section to the first lower section;

a third radiator comprising a third upper section and a fourth upper section on the first plane, a second lower section on the second plane, a third connection section, and a fourth connection section, wherein the third connection section connects the third upper section to the second lower section, and the fourth connection section connects the second lower section to the fourth upper section; and a fourth radiator connecting to the fourth upper section and extending towards the substrate.

2. The solid antenna as claimed in claim 1, wherein the second radiator further comprises a first open end, perpendicularly connected to the second upper section, and extending towards the substrate.

3. The solid antenna as claimed in claim 2, wherein the first connection section, the second connection section, the third connection section, the fourth connection section, and the first open end are in parallel with each other, and perpendicular to the substrate.

4. The solid antenna as claimed in claim 2, wherein the fourth radiator is L-shaped, and comprises a second open end extending towards the first open end.

5. The solid antenna as claimed in claim 1, wherein the feeding portion and the short portion are elongated, and parallel to the fourth radiator.

6. The solid antenna as claimed in claim 1, wherein the short portion connects to one end of the first upper section far away from the first lower section, and the feeding portion connects to a middle part of the first upper section.

7. The solid antenna as claimed in claim 6, wherein the first upper section is in a rectangular shape, and defines a first slot to tune operating frequency of the solid antenna by adjusting the dimensions of the first slot.

8. The solid antenna as claimed in claim 1, wherein the third upper section connects to the second upper section, which collectively form an L shape, and the L shape structure makes the third radiator and the first radiator define a second slot therebetween.

9. The solid antenna as claimed in claim 1, wherein the fourth upper section is L-shaped to make the third radiator and the fourth radiator define a third slot therebetween.

10. The solid antenna as claimed in claim 1, further comprising a grounding portion covering the substrate, wherein the short potion electrically connects to the grounding portion.

* * * * *